US006651743B2

(12) United States Patent
Szarka

(10) Patent No.: US 6,651,743 B2
(45) Date of Patent: Nov. 25, 2003

(54) SLIM HOLE STAGE CEMENTER AND METHOD

(75) Inventor: David D. Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/864,962

(22) Filed: May 24, 2001

(65) Prior Publication Data

US 2002/0174986 A1 Nov. 28, 2002

(51) Int. Cl.[7] ..... E21B 33/132

(52) U.S. Cl. ..... 166/285; 166/291; 166/153; 166/154; 166/177.4

(58) Field of Search ..... 166/285, 291, 166/373, 387, 153, 154, 177.4, 187, 324, 332.4, 332.7, 334.4

(56) References Cited

U.S. PATENT DOCUMENTS

| | | | | | |
|---|---|---|---|---|---|
| 2,155,609 | A | | 4/1939 | McClendon et al. | 166/1 |
| 2,846,015 | A | | 8/1958 | Pittman | 166/224 |
| 2,847,074 | A | | 8/1958 | Mayl et al. | 166/224 |
| 3,223,160 | A | | 12/1965 | Baker | 166/27 |
| 3,768,556 | A | | 10/1973 | Baker | 166/154 |
| 3,768,562 | A | | 10/1973 | Baker | 166/289 |
| 3,776,250 | A | | 12/1973 | Knox | 137/71 |
| 3,811,500 | A | * | 5/1974 | Morrisett et al. | 166/154 |
| 3,948,322 | A | | 4/1976 | Baker | 166/289 |
| 4,421,165 | A | | 12/1983 | Szarka | 166/151 |
| 5,038,862 | A | | 8/1991 | Giroux et al. | 166/289 |
| 5,109,925 | A | * | 5/1992 | Stepp et al. | 166/184 |
| 5,224,540 | A | | 7/1993 | Streich et al. | 166/118 |
| 5,271,468 | A | | 12/1993 | Streich et al. | 166/387 |
| 5,279,370 | A | | 1/1994 | Brandell et al. | 166/386 |
| 5,299,640 | A | | 4/1994 | Streich et al. | 166/327 |
| 5,314,015 | A | | 5/1994 | Streich et al. | 166/187 |
| 5,348,089 | A | | 9/1994 | Brandell et al. | 166/154 |
| 5,390,737 | A | | 2/1995 | Jacobi et al. | 166/184 |
| 5,464,062 | A | | 11/1995 | Blizzard, Jr. | 166/376 |
| 5,526,878 | A | | 6/1996 | Duell et al. | 166/187 |
| 5,641,021 | A | | 6/1997 | Murray et al. | 166/291 |
| 5,738,171 | A | | 4/1998 | Szarka | 166/289 |
| 5,839,515 | A | | 11/1998 | Yuan et al. | 166/387 |
| 5,890,540 | A | | 4/1999 | Pia et al. | 166/321 |
| 5,960,881 | A | | 10/1999 | Allamon et al. | 166/291 |
| 5,984,007 | A | | 11/1999 | Yuan et al. | 166/134 |
| 6,082,459 | A | | 7/2000 | Rogers et al. | 166/334.1 |
| 6,182,766 | B1 | | 2/2001 | Rogers et al. | 166/386 |

FOREIGN PATENT DOCUMENTS

| | | | |
|---|---|---|---|
| EP | 0581533 A2 * | 2/1994 | |

* cited by examiner

*Primary Examiner*—William Neuder
(74) *Attorney, Agent, or Firm*—John W. Wustenberg; Craig W. Roddy; Loren G. Helmreich

(57) ABSTRACT

A small diameter stage cementer assembly 10 and a hydraulically operated packer collar stage cementer 110, including a cementer housing 12 for interconnection with a casing string 14 positionable in a slim-hole wellbore for a cementing operation. The cementer housing 12 including a seat 11 for receiving a lower, drillable portion 335 of an opening sleeve assembly 135 after the upper drillable portion 235 of the opening sleeve assembly 135 has been drilled out. The lower, drillable portion 335 wedges into engagement with the seat 11 to prevent rotation of the drillable portion 335 during drill-out, such that the lower portion 335 may be drilled up using a small diameter bit and drill string, and accommodating a reduced weight on bit. The packer collar embodiment includes a hydraulically actuatable packer 70. In the packer collar embodiment of the stage cementer 110, cementing ports 34 are provided separate in a separate axial plane from hydraulic inflation ports, such that the secondary opening device or rupture disks may be securely positioned within the cementing ports. Thereby, a relatively thin-walled outer case 20 may be utilized for the hydraulic passageway 130 to the packer 70, without having to increase the case outer diameter to accommodate positioning a rupture disk in the case. The stage cementer housing may be sized for use with a casing string 14 with a nominal OD of 4½ inches or less. An improved method of operating a stage cementer is disclosed.

22 Claims, 2 Drawing Sheets

SLIM HOLE STAGE CEMENTER AND METHOD

FIELD OF THE INVENTION

The present invention relates to small-diameter or "slim hole" stage cementers and to related equipment, such as an inflatable packer collar. The slim hole stage cementer of the present invention is designed to facilitate improved drill-out operations.

BACKGROUND OF THE INVENTION

Stage cementers ("cementers") are used in the petroleum production industry during wellbore-tubular cementing operations. Stage cementers, as that term is used herein, includes (1) stage cementer tools, and (2) stage cementers with inflatable packer collar tools.

Stage cementers intended for use in "slim-hole" or small diameter casing strings, i.e., casing strings with nominal diameters of 4½" inches and smaller, create special problems because of their size. Small diameter cementers inherently present significant problems, both operationally and during drill-out. In relatively larger diameter cementers, many of the problems inherent in the design of the tool may be easily resolved because of the relatively large diameter. Compared to larger diameter cementers, small diameter cementers may present operational challenges not present in the larger tools. As a consequence, stage cementers have conventionally been one type of tool in which the small diameter tools may be more expensive to manufacture because of difficulties inherent in working with reduced diameter components.

Prior art slim-hole stage cementers have been successfully used in the past, but these stage cementers may be very expensive to manufacture, challenging to operate, and difficult to drill out after use. With mechanically-operated stage tools, undrilled portions of a partially drilled out plug may free fall to a lower position within the casing in the wellbore. In addition, drill-out of the moving opening seat may break the seat into several large chunks or pieces. Drilling-up the free floating remnants of an opening seat may be very difficult and risky, with use of the small diameter work strings required to operate inside the small diameter casing. Such small diameter work strings inherently have limited weight on bit and torque capabilities.

A small diameter stage cementer with an inflatable packer collar has, to the knowledge of the applicant, never been manufactured or sold. Stage cementers for nominal casing sizes greater than 4½ inches do not generally present many of the problems associated with small diameter/slim-hole stage cementers.

With the increased cost of drilling, improved wellbore completion technologies, and the need to reduce well drilling costs, slim-hole drilling is becoming increasingly popular. Such popularity has been especially recognized in remote areas. In order to improve realization of the objectives for drilling small diameter wellbores, and to meet the demands for improvements in small-diameter wellbore equipment and procedures, there is a need for an improved stage cementer for use within oilfield casing having a nominal outside diameter 4½ inches or less. Other problems with prior art stage cementers include the difficulty of drilling out the drillable components of the tool after the cementing operation is complete, while still providing a reliably useable and operating tool.

In a larger, more conventionally sized cementer, drill-out of the opening and closing seats may be accomplished relatively easily, in that the internal diameter of the cementer permits use of relatively large drill collars, thereby facilitating applying a relatively substantial weight on bit. If a seat is broken up or free falls, it may be chased by the bit and thereafter effectively drilled up downhole. Such practice is very difficult, relatively expensive, and time consuming in slim-hole casings. Drilling out a slim-hole stage cementer is commonly performed with a slim-hole string, such as 1⅝ inch drill pipe or coiled tubing. Either type of string permits severely limited weight on the bit and limited torque to be transmitted through the drill string to the drill bit.

Other problems are also present in small diameter packer collars configured or manufactured like larger diameter cementers or packer collars. Conventionally sized hydraulically opened stage cementers typically include a cylindrical, sleeve or tubular-shaped outer case surrounding a concentrically positioned, tubular-shaped, inner case, forming a concentric annulus there-between. In a packer collar tool, a port is provided through both cylinders/cases, with the portion of the port through the outer case including a secondary opening device affixed therein, such as a rupture disk, to plug or seal that portion of the port. In operation of the cementer, an opening sleeve is moved to an opened position, exposing the port in the inner case to the interior of the cementer. Thereby, fluid may be pumped from within the casing, through the port in the inner case, through the concentric annulus, and cause inflation of a packer element, positioned on a lower end of the packer collar. The secondary opening device must withstand the inflation fluid pressure without opening until after packer element inflation is complete.

Thereafter fluid pressure is increased causing the secondary opening device to rupture or open, such that the cementing operation may proceed. Cementitious fluid is then pumped through the port in each of the inner and outer cases. Thus, the port in the inner case functions as both a cementing port and an inflation port, and the port in the outer case functions only as a cementing port. The ports may share a common port axis.

Problems arise with small diameter hydraulically operated stage collar cementers and packer collar cementers designed as described above. To effectively and safely place the cement in the wellbore in timely fashion before the cement begins to thicken a minimum fluid pump rate must be obtained through the cementing ports. As a result, the cementing ports in the cementer's concentric sleeves has a relatively large diameter, as compared to the diameter of a port required to merely inflate the packer. Consequently, in a small diameter tool, the loss of steel or tool material to provide the required port cross-sectional area may limit the tensile working strength of the cementer. This effect may be even more pronounced where the tensile bearing sleeve is the inner sleeve, as this sleeve has an even smaller ID and OD than the outer sleeve, and wall thickness increases are prohibitive to permit a required minimum throughbore ID. The result is a limitation to the amount of casing that can be run below the stage cementer, and/or a limit to the amount of tension that may be pulled in the casing for straightening purposes prior to cementing.

There is thus a need for an improved small diameter stage cementer, a small diameter stage cementer with inflatable packer collar, and a stage cementer, which facilitates improved subsequent drill-out operations. An improved small diameter stage cementer and a method of operating a stage cementer with an inflatable packer collar are subsequently described. The stage cementer and method of this invention thus overcome many of the difficulties and shortcomings of the prior art.

SUMMARY OF THE INVENTION

According to a preferred design, both the improved slim-hole stage cementer of the present invention and the combination stage cementer and inflatable packer collar open hydraulically, as do some existing prior art cementers. This hydraulic actuation is a departure, however, from the numerous prior art designs for small diameter, mechanically operated stage cementer tools, which typically require an opening plug to seat on an opening seat to open the ports. Since the present cementer tool is hydraulically opened, this is a significant advantage in tool operation and in cementing, saving time and equipment. A hydraulically operated tool also has the advantage of not requiring drill-out of an opening plug.

Improved drill-out of the cementer according to the present invention is facilitated in one sense, by constructing the drillable portions of the tool, including both the opening and the closing seats, from high strength plastic or composite materials. Improved drill-out is facilitated in another sense, in that when in fully closed positions, both the opening and closing sleeves preferably are splined together and are splined to the lower body to keep components from spinning during the drill-out operation. Drill-out is enhanced in a third and perhaps most significant sense, in that after drilling the first few inches of the opening seat, the bottom portion of the opening seat will fall or be pushed down a few inches to wedge into a reduced ID portion of cementer body. The lower portion of the opening seat may be designed to have a slightly larger OD than the ID of the minimum bore of the lower body. This will cause the lower remaining portion of the opening seat to wedge in the restriction so that the lower portion of the opening seat may be drilled out without rotating or moving under the bit. This interference fit that occurs in the minimum ID of the lower body, where the ID is less than the minimum OD of the opening sleeve substantially assists in drill-out of the opening sleeve.

The opening seat may be fixedly secured to an opening sleeve, such that the two components move between an open and closed position together. The seat portion may be the drillable portion, while the sleeve portion is the permanent portion. In like fashion, the closing seat may be secured to a closing sleeve, wherein the seat is drillable, and the sleeve is permanent.

Hydraulic opening may be facilitated by applying pressure within the casing and cementer throughbore, such that the pressure acts across the differential area between the OD of the seals carried on the opening seat and sleeve, and the corresponding sealing ID on the lower body. The opening pressure may be preset by using selected shear member, such as shear pins or a shear ring. In a disclosed embodiment, the opening seat shear member connects the cementer body to the lower portion of the opening seat. The opening shear mechanism may be located at the lower end of the opening seat in order to facilitate putting the opening pins (or controlled strength shear ring) in pure shear failure (as opposed to a shear-tensile failure), as well as to move the shear location away from areas passed by permanent seals. To change the opening pressure set-point, the cementer may be partially disassembled to change the shear members. In a "welded" version of the tool, the opening pressure may not be adjusted once the tool has been assembled. The closing pressure may be selected and set using a controlled strength shear ring or a shear pin arrangement between the closing sleeve and the body.

For the packer collar version of the tool, inflation of the packer may be facilitated in the same basic fashion as a conventional tool, with a variation for strength considerations. Separate port(s) may be provided for inflation of the packer element, and for conducting cement from inside of the cementer to outside of the cementer.

After the opening sleeve has moved to the opened position, fluid may flow through the small diameter inflation ports and into a concentric/cementer annulus between an inner case/tensile member and an outer case. The inner case/tensile member may be referred to as the cementer mandrel, while the outer case may be referred to as the outer case. The inflation ports may be positioned in a different plane from the cementing ports, such that the inflation ports are located below the cementing ports. The cementing ports may include a rupture disk and equalizer valves positioned within one or more cementing ports in the tensile member of the tool. A stage cementer version of the cementer without the packer would not include an outer case, rupture disk(s), and equalizer valve(s).

Fluid may continue down the cementer annulus between the packer mandrel and the outer case, past a one-way ring check valve and into the packer cavity, inflating and setting the packer. As the packer inflates, pressure is also acting against the rupture disks in the mandrel. When packer has fully inflated and the inflation pressure continues to increase to the predetermined failure pressure of the rupture disk, this disk will rupture, thereby allowing fluid circulation to the wellbore annulus above the inflated packer element and between the outer surface of the casing string and an inner surface of the wellbore. The one-way check valve in the top of the packer element retains the full inflation pressure within the inflated packer element. In a less preferred embodiment, the opening seat on the packer collar could be mechanically set by seating an opening plug thereon.

After the prescribed amount of cement has been pumped, a closing plug may be released and pumped downhole with the tail of the cement, as consistent with known conventional multiple stage cementing practices, to form a pressure shut-off against the closing plug seat. Pressure may be subsequently increased sufficiently to shear the closing sleeve retaining device which holds the closing sleeve in place allowing the closing sleeve to reposition downward to the closed position. When the closing sleeve moves to its fully closed position, a lock-ring located on the OD of the closing sleeve may spring out into an ID undercut near the cementing ports, thereby locking the closing sleeve permanently closed. The undercut in the outer portion of the body also protects the lower set of permanent seals and the closing sleeve from damage while crossing the cementing ports. After the cement has cured sufficiently, the drillable closing and opening seats, and the cement in the cementer may be drilled out. When the top portion of the opening seat is removed during drillout, the lower portion may fall and wedge into the reduced ID restriction in the cementer body, such that the lower portion may be efficiently drilled up without moving under the bit.

It is an object of the present invention to provide an improved slim-hole stage cementer and an improved method of operating a stage cementer.

A feature of the present invention is to provide an improved stage cementer with an inflatable packer collar intended for slim hole (less than or equal to 4½" nominal OD) operations.

It is a feature of the present invention that the stage cementer opens hydraulically, rather than being a mechanically opened stage cementer.

Yet another feature of the invention is to provide a stage cementer which facilitates efficient drill-out. A related feature of the invention is that drillable components of both the opening and closing seats may be formed from composite materials. A related feature of the invention is that both the opening and closing seats may be splined together and/or to the lower body to keep components from spinning during the drill-out operation.

Yet another feature of the invention is to provide a stage cementer such that, after drilling the opening seat a short distance, the bottom portion of the drillable opening seat may fall down to a reduced ID in the cementer body. The opening seat may thus wedge in the restriction so that the remaining portion of the seat may be drilled out without undue difficulty.

Yet another feature of the invention is that the tool may be a packer collar version, or a stage cementer version.

Still an additional feature of the invention is that the opening pressure set-point and/or the closing pressure set point may be factory set, or adjusted after initial assembly.

It is a further feature of the invention that the cementer tool may be closed by pumping a closing plug to form a pressure seal against a closing seat. Pressure may then be increased to shear a shearable retaining member which holds the closing sleeve in place. A lock-ring may spring out into the ID undercut in the outer body when the closing sleeve is in the fully closed position, thereby locking the sleeve permanently closed.

It is an advantage of the present invention that the hydraulically inflated packer may be similar to prior art packers, with modifications to packer components. The tool may include cementing ports, rupture disks, and equalizer valves in the mandrel or inner case, and not within the outer case. The packer may be hydraulically set/inflated and the check valve closed to retain the setting pressure in the packer. When the inflation pressure increases to the point of a predetermined failure pressure of the rupture disk(s), the disk(s) will rupture thereby allowing circulation to the wellbore annulus above the inflated packer element.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
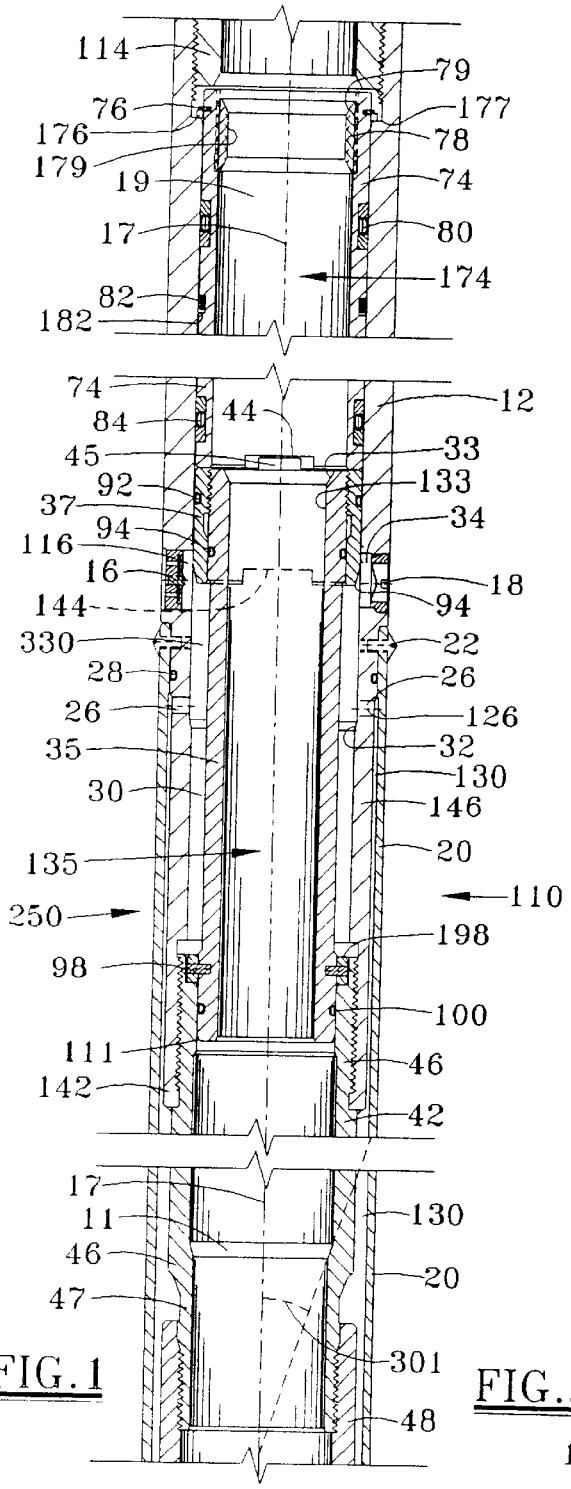
FIGS. 1 and 2 together illustrate in cross section one embodiment of a packer collar slim hole stage cementer according to the present invention.
Figure 2:
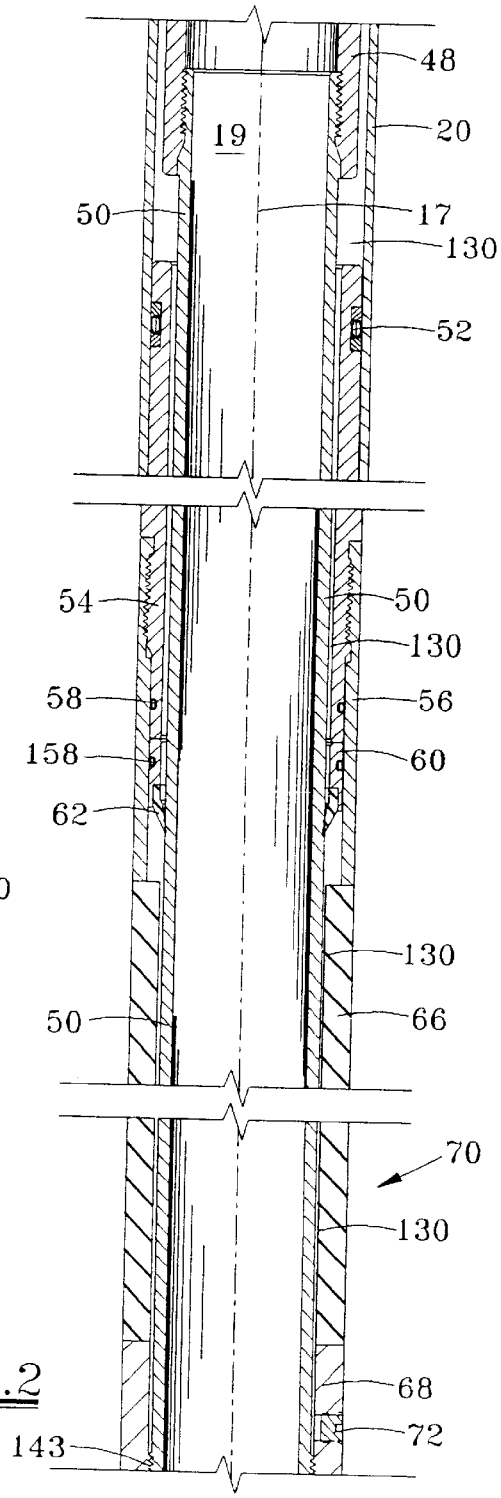
Figure 3:
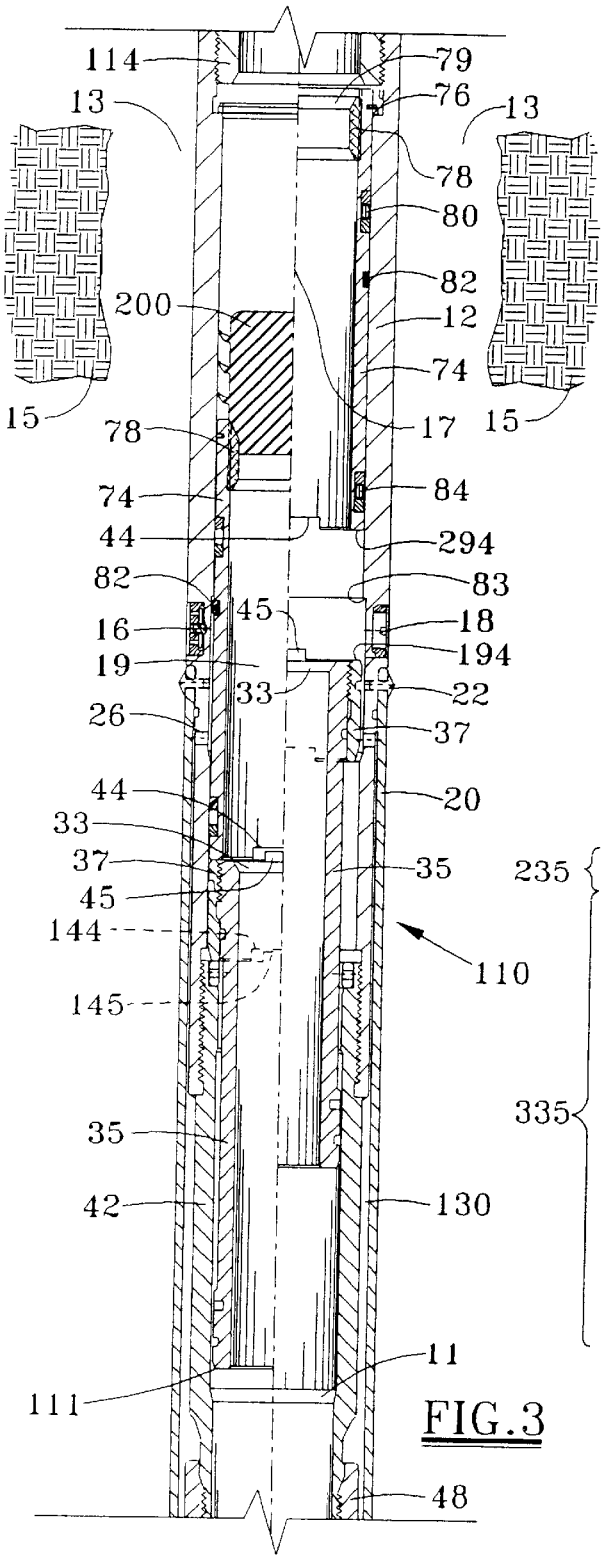
FIG. 3 is a packer-collar stage cementer version in half sectional view, illustrating the opening sleeve and the closing sleeve in the run-in position in the right-side view and in the fully closed position in the left-side view.
Figure 4:
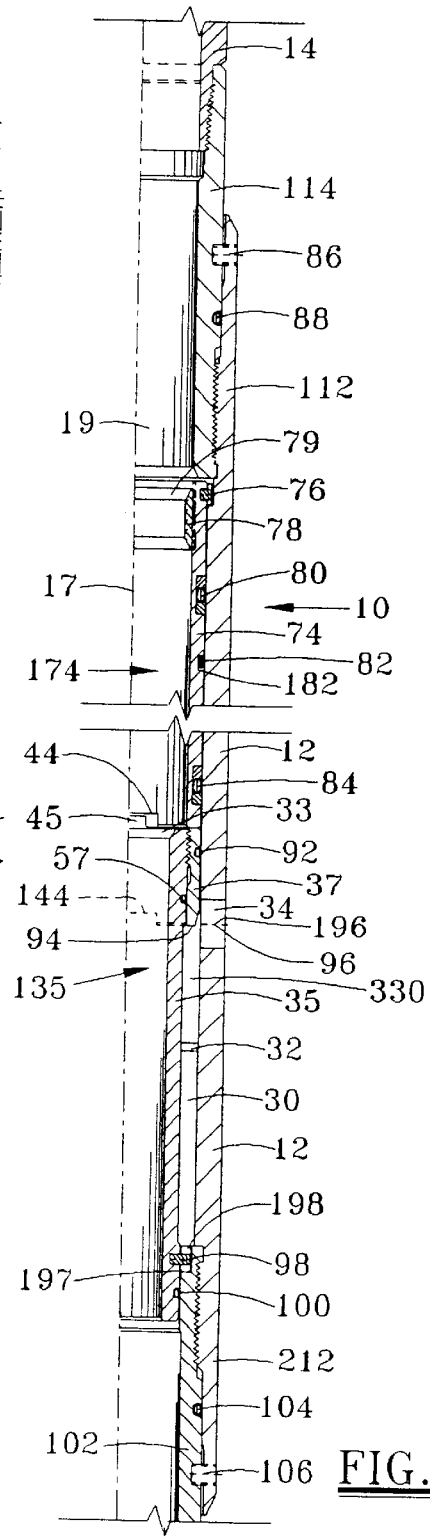
FIG. 4 is a half cross sectional view of an alternative non-welded version of a stage cementer, with the cementer being threaded rather than welded to a string coupling on each end of the cementer.

FIGS. 1, 2, 3 and 4 illustrate suitable embodiments of stage cementer tools 10 and 110, according to the present invention. FIGS. 1, 2, and 3 illustrate a packer collar stage cementer embodiment 250, including a stage cementer 110 mechanically and hydraulically interconnected with a hydraulic packer assembly 70. FIG. 4 illustrates a stage cementer embodiment 10, without a packer assembly.

As illustrated in FIG. 4, a stage cementer 10 may include a cementer housing 12, which may be welded or threadably secured to a tubular casing string 14. The casing string 14 preferably may be a small diameter casing string, having a nominal outer diameter less than or equal to 4½ inches. An upper coupling 114 may be secured to an upper end of the cementer housing 12 and to the casing string 14. The casing string 14 including the cementer 10 thereafter may be positioned within a wellbore 13 in a subterranean formation 15, as illustrated in FIG. 3.

A cementer axis 17 may be defined along a central through bore 19 within the cementer housing 12. The cementer housing may include one or more cementing ports 34 having a cementing port axis 96. Each cementing port axis 96 may be defined within a common cementing port plane 196. Cementing ports may be opened by moving an opening sleeve assembly 135 from the closed position to the opened position. When opened and in fluid communication with the central through bore 19, each of the cementing ports 34 may pass fluid from the central through bore 19 to outside the cementer housing, such as into a wellbore annulus 13. The cementer housing 12 may include an upper end 112 above a lower end 212. The cementer housing may be a substantially one-piece, substantially tubular-shaped housing, such as illustrated in FIG. 4. Such embodiment may include a coupling 114, 102 on each end of the housing 12 to connect the cementer within the casing string 14. End couplings may also permit insertion and retention of interior components within the cementer housing 12.

An opening sleeve assembly 135 may be positioned within the cementer housing 12, and may comprise a non-drillable opening sleeve portion 37 secured, such as by threads, to a drillable opening sleeve portion 35. The opening sleeve assembly 135 may be moved axially from a closed position for preventing passing fluid through the one or more cementing ports 34 to an opened position for passing fluid through the one or more cementing ports 34. The opening sleeve assembly 135 may have a seal differential with respect to the cementer 12 housing for hydraulically moving the opening sleeve assembly 135 with respect to the cementer housing 12 in response to a fluid pressure in the cementer housing 12. The fluid pressure for moving the opening sleeve assembly may be an opening shear pressure, sufficient to shear the shear member 98, such as a shear ring and/or shear pins, axially securing the opening sleeve assembly 135 within the housing 12. The seal differential may facilitate a pressure differential between the fluid pressure in the cementer through bore versus the fluid pressure in the wellbore annulus 13 and/or the fluid pressure in an annular area 330, 30 around an outside portion of the opening sleeve assembly between seals 92, 94 and 100. The equalizer valve 16 may permit the wellbore annulus 13 pressure to equalize with the annular area 330, 30.

The opening shear member 98 may provide a first selected shear strength for disengagingly securing the opening sleeve assembly 135 to the cementer housing 12, and for shearing when the opening sleeve assembly 135 moves from the closed position to the opened position. The embodiment illustrated in FIGS. 1, 3 and 4 provide a ring member 198 with shear pins 98 engaging each of the ring member 198 and the opening sleeve assembly 135. The ring member 198 is engaged against shoulder 197 on an upper end of coupling 102 in a stage cementer embodiment without a packer assembly 70, as illustrated in FIG. 4, or against a shoulder on an upper end of lower body 46 in a packer collar embodiment, such as illustrated in FIG. 1.

In a preferred embodiment, the cementer housing 12 and all non-drillable components in the cementer housing, such as 37 and 74, may be constricted from a drill-resistant, rigid metallic material, such as steel. Drillable components preferably may be constructed from relatively easily drilled materials, such as composites. The term composites may be defined broadly to include rigid formable and/or machineable thermoplastics, non-metallic plastics, rigid polymer compounds, thermo-set resinous materials, carbon-fiber materials, epoxy materials, or other man-made materials, and may further include relatively soft metals and alloys, including aluminum-based materials or components therein. A drillable component is one that may be expected to be drilled out under typical operating circumstances, and a non-drillable component is one that normally would not be drilled out. Non-drillable does not mean that the material the component is fabricated from is not drillable.

In a preferred embodiment, a closing sleeve assembly 174 may be positioned within the cementer housing 12, and may comprise a non-drillable closing sleeve portion 74 secured such as by threads to a drillable closing sleeve portion 78. The closing sleeve assembly 174 may including a closing plug seating surface 79 for sealingly engaging a closing plug 200 thereon to move the closing sleeve assembly 174 in response to another fluid pressure in the stage cementer housing 12. The another fluid pressure is applied above the plug 200 and may be a selected closing shear pressure, sufficient to shear the closing shear member 76, such as a shear ring or shear pin(s), axially securing the closing sleeve assembly 174 with the housing 12. The closing sleeve assembly 174 may thereafter move from an opened position for passing fluid through the cementing ports 34 to a closed position for preventing fluid from passing through the cementing ports 34.

The closing shear member 76 may provide a second selected shear strength for disengagingly securing the closing sleeve assembly 174 to the cementer housing 12, and for shearing when the closing sleeve assembly 174 moves from the opened position to the closed position. The embodiment illustrated in FIGS. 1 illustrates a shear ring 76 with a backup ring 176 to provide a square shear surface positioned between shear ring 76 and shoulder surface 177, such that shear ring 76 may be sheared substantially flush with an outer surface of the closing sleeve assembly 174. Prior to shearing, the shear ring 76 may engage each of the closing sleeve assembly 174 and the ring member 176. FIG. 4 illustrates a shear member embodiment utilizing a shear pin 76 engaging each of the closing sleeve assembly 174 and the housing 12. Is should be noted that either shear member arrangement (shear ring or shear pins) may be used to restrain both the opening and closing seats.

The cementer housing 12 includes an opening sleeve portion seat 11, as seen clearly in FIGS. 1 and 3, along the central through bore 19 for preventing rotation of a lower portion 335 of the drillable opening sleeve portion 135 during drill-out. The opening sleeve portion seat 11 may comprise a substantially frustoconical wedge-shaped portion 11, which preferably may be formed at an angle 301 with respect to the cementer axis 17 of up to 70 degrees, as illustrated in FIG. 1. The opening sleeve portion seat 11 may be substantially frustoconical shaped, in that the tapered ID reduction effected by the seat 11 also may be formed to include a slightly concave or convex curvature along an imposed frustoconical plane of projection.

Referring to FIGS. 1 and 4, the lower portion 335 of the drillable opening sleeve portion 35 may include an engagement surface 111 for engaging the opening sleeve portion seat 11 during drill-out. After a first portion 235 of the drillable opening sleeve portion 35 is drilled out, the lower portion 335 may fall or be pushed by the drill bit axially downward through the through bore 19 causing surface 111 to engage and securably wedge into seat 35. Thereby, engagement of surface 111 with seat surface 11 may prevent rotation of the lower portion 335 of the drillable opening sleeve portion 135 during drill-out of the lower portion 335. The primary purpose for the tapered seat 11 is to secure the lower portion 335 against rotation and thereby assist in drill-out with requiring a significant increase in weight-on-bit. Applying a relatively significant weight-on-bit in small diameter casings and cementing tools may be difficult or impossible to effect. The lower portion of the opening sleeve assembly may be designed to have a slightly larger OD than the ID of the minimum bore of the lower body. This will facilitate the lower remaining portion of the opening seat wedging in the ID restriction such that the lower portion of the opening seat may be drilled out without rotating or moving under the bit. This interference fit that occurs in the minimum ID of the lower body, where the ID is less than the minimum OD of the opening sleeve substantially assists in drill-out of the opening sleeve.

The opening sleeve assembly 135 sealingly and moveably engages the housing 12 across an axial length of the housing 12 having a relatively larger ID and a relatively smaller ID, thereby creating a seal differential/differential area by which an increase in hydraulic pressure within the housing may axial move the opening sleeve assembly 135 from a closed position to an opened position. Prior to movement to the opened position, the shear member 98 which prevents undesired, premature sleeve movement, may require shearing.

The seal differential may be created by a differential area between the large diameter seal 92 and the smaller diameter seal 100, both on the opening sleeve assembly 135, creating a differential area with respect to the two seals 92 and 100. This differential area is acted upon both by the pressure inside the pipe as well as the hydrostatic pressure in the annulus at the tool to generate an upward force (annulus pressure) and a downward force (casing pressure). The tool will open when the downward force equals the sum of the upward force plus the force required to shear the restraining device/shear member 98. The equalizer valve 16 used in packer collars not only protects the rupture disk(s) 18 by keeping annulus fluid pressure equalized across the disk(s) 18, the equalizer valve 16 also transmits the annulus fluid pressure to the back side of the opening seat assembly 135 so that the tool 110 will open at the predicted condition downhole.

In the event insufficient hydraulic pressure is available to move the sleeve 135 from the closed position to the opened position, or if for other reasons the sleeve 135 does not shear free or move, additional force may be applied by dropping an opening plug or ball from the surface, through the casing string 14 to the sleeve 135. The opening sleeve assembly 135 may include an opening plug seating surface 33 for optionally receiving and seating the opening plug/ball thereon to assist in hydraulically opening the opening sleeve assembly 135. The opening plug seating surface 33 may include a minimum opening seat nominal through bore diameter 133. In a preferred embodiment, the opening plug seating surface 33 may include a minimum opening seat nominal through bore diameter 133 substantially equal to a minimum opening sleeve assembly 135 through bore internal diameter.

The closing sleeve assembly 174 includes the closing plug seating surface 79. The closing plug seating surface 79 includes a minimum closing seat nominal through bore diameter 179 greater than the minimum opening seat nominal through bore diameter 133. Thereby, in the event that an opening plug is used, the opening plug may pass through the closing plug seating surface 79 and seat in the opening sleeve seating surface 33. Thereafter, the larger-diameter closing plug 200 may seat on the closing seat 79, as depicted in FIG. 3.

The opening sleeve assembly 135, defined in FIG. 4, may be moved axially from a closed position as illustrated in FIG. 3, for preventing passing fluid through the one or more cementing ports 34 to an opened position for passing fluid through the one or more cementing ports 34. Axial movement to the opened position may be limited by engagement of non-drillable opening sleeve portion lower surface 94 engaging a shear ring member 198. Annular area 330 includes a larger diameter with respect to the inner surface of the housing 12 as compared to annular area 30 such that the opening sleeve assembly may move to the opened position substantially unimpeded. Depending upon the kinetic energy within the opening sleeve assembly as it moves to the opened position, frustoconical surface 32 may guide seal 92 and the non-drillable portion 37 of the assembly 135 axial along annular area 30 until surface 94 engages a stop surface such as on ring 198. In preferred embodiments, angled surface at 32 is not a stop shoulder, but rather a seal re-entry angle to prevent seal damage to closing sleeve member lower seal 84, when closing the tool. When moving the opening sleeve assembly 135 to the opened position, seal 92 on the opening sleeve may or may not enter the seal bore 30 at the base of the angled surface 32 depending upon the stored energy in the sleeve assembly 135 when the shear device 98 shears. In any event, the opening sleeve will either go full travel, stopping at ring 198 near the top of the lower adapter due to the release of the stored energy overcoming any frictional forces, or the sleeve assembly 135 will be moved to the "full down" position by the closing sleeve 174 pushing it 135 the remaining distance.

Axial movement of the closing sleeve assembly 174 from the opened to the closed position may be limited by engagement of non-drillable closing sleeve portion lower surface 294 with non-drillable opening sleeve portion upper surface 194 on non-drillable portion 37. Lower closing sleeve surface 294 may include one or more grooves 44 for engagement with one or more corresponding splines/lugs 45 provided on the upper surface 194 of non-drillable sleeve 37, when the closing sleeve assembly 174 is moved to the closed position. In other embodiments, respective component location of splines 45 and grooves 44 on may be reversed.

In a preferred embodiment, FIG. 3 depicts, in the right hand view, the opening sleeve assembly 135 in the opened position, but not moved full stroke, and the closing sleeve assembly 174 is in the run-in position. The left-side view of FIG. 3 illustrates the opening sleeve assembly 135 fully repositioned in the opened position, and the closing sleeve assembly 174 is fully repositioned closed. FIGS. 1 and 4 illustrate the opening and closing sleeve assemblies both in the run in position. The travel of the opening and closing seats from the run-in position to the opening sleeve opened position and the closing sleeve closed position, and the travel between those positions, is thus set forth in FIGS. 1, 3 and 4.

At least a portion of the opening sleeve assembly 174, the non-drillable portion 37 may be secured to the cementer housing 12 by one or more splined connections to prevent rotation of the non-drillable portion 37 during drill-out. Preferably, the non-drillable opening sleeve portion 37 may include a spline/lug 144, which may engage a groove 145 in an inner surface of the housing 12 to prevent rotation of the non-drillable portion 37 of the opening sleeve assembly 135 relative to the housing 12 during drill-out.

Several seal members may be included to provide fluid tight seals within the cementer 10. Seal members preferably may include an O-ring groove and an O-ring seal member 92 positioned within the O-ring groove. The opening sleeve assembly 135 may include an upper housing seal member 92 positioned between an exterior surface of the non-drillable opening sleeve portion member 37 and an inner surface of the housing 12. The opening sleeve assembly 135 may include a lower housing seal member 100 between an outer surface of the opening sleeve assembly 135 and an inner surface of the cementer housing 12. A drillable portion seal member 94 may be provided between an inner surface of the non-drillable opening sleeve portion member 37 and an outer surface of the drillable opening sleeve member 35.

The closing sleeve assembly 174 may include upper 80 and lower 84 closing assembly housing seal members between an exterior surface of the closing sleeve assembly 174 and the cementer housing 12. The drillable closing sleeve portion 78 may be sealingly engaged with the non-drillable closing sleeve portion member 74 by a threaded engagement there-between, or by an additional seal member (not shown).

A lock member 83 may be provided within the cementer housing, such as an undercut groove 83 in an interior wall of the cementer housing 12. A locking member, such as a lock-ring groove 182 and lock-ring 82, may be provided on the closing sleeve assembly. Preferably, the lock-ring 82 may be an expandable split-ring, such that when the closing sleeve assembly 174 moves axially to the fully closed position, the lock-ring 82 may circumferentially expand at least partially into the undercut portion 83 to prevent the closing sleeve assembly from moving axially back to an opened position. Preferably, the lock member 83 in the cementer housing and the locking member in the closing sleeve assembly 174 are both positioned between the upper seal 80 and the lower seal 84 on the closing sleeve assembly 174 when the closing sleeve assembly 174 is in the closed position.

It is also preferable that the opening shear member 98 is located axially below the lower seal member 84 when the closing sleeve assembly 174 is in the closed position. Thereby, neither of the closing sleeve assembly seals 80 and 84 move past sheared members when the closing sleeve assembly 174 moves to the closed position.

In a threaded cementing housing embodiment, such as illustrated in FIG. 4, upper coupling 114 and lower coupling 102 may be threadably engaged with the upper and lower ends of the housing 12, respectively. Upper seal 88 and lower seal 104 may be included to provide fluid tight connections with the respective upper and lower ends of the housing 12. Upper 86 and lower 106 securing members, such as set-screws, may be provided to prevent the respective couplings from unthreading as the casing 14 is run into the wellbore 13 and/or during drill-out. Embodiments utilizing threaded couplings may also include a seal member 100 between the lower coupling 102 and an outer surface of the opening sleeve assembly 135. In other embodiments, the couplings 114 and 102 may be welded into engagement with the housing 12, such that neither threads or nor seal members 88 and 104 may be required.

FIGS. 1, 2, and 3 illustrate a packer collar stage cementer embodiment 250, including a modified stage cementer portion 110, mechanically and hydraulically interconnected with a hydraulic packer assembly 70. The stage cementer portion 110 of the packer collar embodiment 250 may function similar to the stage cementer 10 described previously in the detailed specification, with modifications for use compatible with the hydraulically actuated packer assembly 70. In a packer collar stage cementer embodiment 250, such as illustrated in FIG. 1, the lower coupling 102 in the previously described stage cementer embodiment 10 such as illustrated in FIG. 4, may be referred to as a lower body 46. The cementer housing 12 may comprise an upper body 146 secured to a lower body 46. The upper body 146 in the packer collar embodiment 250 may be substantially analogous to the housing component 12 in the stage cementer embodiment 10. An upper end 42 of the lower body 46 may be secured to a lower end 142 of the upper body 146, such as by threads, and a lower end 47 of the lower body 46 may be threadably secured to a coupling 48, which in turn is secured to a tensile load bearing mandrel 50 of the packer assembly 70. A lower portion of the casing string 14 may be threadably connected to a lower end of the packer mandrel 50.

Referring to FIGS. 1, 2, and 3, the upper body 146/cementer housing 12 includes one or more cementing ports 34 in the cementer housing 12, as in the above described stage cementer 10. In addition, the packer collar stage cementer 110 may include in each cementing port 34, a secondary opening device 18, such as a rupture disk. The secondary opening device 18 selectively maintains the cementing ports 34 closed to fluid flow there-through initially following moving the opening sleeve assembly 135 from the closed position to the opened position. Thereby, the hydraulically actuated packer assembly 70 may be actuated prior to pumping cementing fluid through the cementing ports 34. The packer collar cementer housing 12 also may include one or more pressure equalizing valves 16 in the cementer housing 12 to operate in conjunction with a closed secondary opening device 18, as discussed below.

The packer collar cementer 110 includes a tubular-shaped outer case 20 circumferentially encompassing an axial length portion of the external surface of the cementer housing 12. The outer case 20 may be fixedly connected to the housing by one or more pins 22 or by other suitable mechanical connectors, such as threads, to the upper body 146. Upper seal 28, as shown in FIG. 1 may form hydraulic seals between an inner surface of an upper end of the outer sleeve 20 and an external surface of the housing 12.

In addition to the one or more cementing ports 34, the cementer housing 12 includes one or more inflation ports 26, as shown in FIGS. 1 and 3, for passing the actuation fluid to inflate or actuate a packer element 66 in the packer assembly 70. The one or more inflation ports 26 preferably may be positioned along the cementer axis 17, axially lower than the one or more cementing ports 34. Preferably, the inflation ports 26 may be positioned within an inflation port plane 126 perpendicular to the cementer axis 17, and axially lower than the cementing port plane 196.

In prior art hydraulically operated packer collar stage cementers, common ports are used for inflation and cementing. An inflation passageway in fluid communication with the common ports are provided between concentric tubular members 12, 20. Each common port has a port axis passing through both concentric tubular members 12, 20. The secondary opening devices are supported in the outer concentric tubular member/case 20. Thereby, when the opening sleeve assembly is moved to the opening position, the packer assembly may be actuated hydraulically by conducting actuation fluid through the portion of the common port in the inner concentric tubular member, and then through the annular conduit to the packer assembly. The secondary opening device is supported in the outer tubular member, prohibiting circulation to the wellbore 13.

In the small diameter cementer according to this invention, the outer case 20 is relatively thin-walled, due to reduced clearances and tolerances, and as such may be less than ideal for competently supporting a secondary opening device in a port therein, without increasing the OD of the cementer. In a packer collar stage cementer 110 according to this invention, the cementing port 34 and secondary opening device 18 therein are positioned within the upper body/housing 12 axially above the portion of the cementer 110 encased by the outer case 20. The cementing port 34 does not penetrate the outer case 20.

Secondary opening devices 18 may not be designed to withstand a substantially high annulus pressure with respect to the fluid pressure in the through bore 19. The equalizer valve 16 may be used in stage packer collars containing rupture disks or other secondary opening devices 18, and may be provided in an equalizer port 116 or in an additional cementing port 34. The equalizer valve 16 acts as a one-way check valve to transmit annulus fluid pressure to the concentric annulus 30 on the back side of the opening seat assembly, as well as to equalize annulus pressure across the rupture disk(s) 18.

A lower end of the tubular-shaped outer case 20 may extend axially from the point of attachment with the housing 12, toward the packer assembly 70, with an annular gap 130 formed between the mandrel 50 and the case 20. Lower cylinder member 56 may be provided for assembly of the packer 70 and to permit insertion of check valve 62 therein. An actuation fluid flow path 130 is thus created for conducting actuation fluid between an external surface of the cementer housing 12 and an inner surface of the outer case 20, and from the inflation port 26 to the packer assembly 70. The flow path 130 may be formed as an annular gap 130, as illustrated in FIGS. 1, 2, and 3, or by a flow channel (not shown).

The packer assembly 70 may include a tubular-shaped, cylinder members 54 and 56 disposed concentrically around the mandrel 50, and in moveable, hydraulically-sealed engagement with an inner surface of the case 20. The packer assembly 70 may also include a tubular-shaped lower housing member 68 disposed concentrically around a lower end of the mandrel 50. The lower housing member 68 may be secured to and in sealed engagement with the lower end of the mandrel 50, such as by threads 143 or a bonding agent. One or more suitable elastomeric packer elements 66 may be provided between the cylinder member 56 and the lower housing member 68. A pipe plug 72 may be positioned within a port in the lower housing 68 for pressure integrity testing of the packer sub-assembly 70 during construction.

Hydraulic actuation fluid may apply hydraulic pressure from the central through bore 19, through the inflation port 26, along the actuation fluid flow path 130. The hydraulic pressure may cause cylinder members 54 and 56 to move axially downward with respect to the case 20 and mandrel 50 as the packer element is inflated or actuated into hydraulic sealed engagement with the formation 15. A check valve assembly may be provided, including check valve member 62 and check valve support ring 60, to prevent the actuation fluid from back-flowing into the central through bore 19 and unactuating an actuated packer element 66.

In a typical casing cementing operation, the cementer 10 may be positioned at a selected point in a casing string to be cemented in a wellbore. Additional float and/or cementing equipment may be included, such as a float shoe, float collars, baffle adapters and other multi-stage cementing equipment. In some applications, it may be desirable to effect a hydraulic seal within a cementing pipe string 14, such as between stages in a multi-stage job, or after running casing into a well and/or to operate hydraulic tools, such as the hydraulic cementer 110. A packer or other mechanism may be provided for hydraulically sealing the interior of the casing string to effect the required hydraulic seal. A baffle adapter may be positioned within the casing string below the multi-stage cementer, wherein a ball or shut-off plug may be dropped or pumped from the surface, through the casing string, to pass through the cementer and seat in the baffle. In another example, a float shoe or float collar may be positioned below the cementer. A shut-off plug may be pumped through the cementer to seat in a baffle profile in the top float valve. When the ball, plug or other sealing device has fallen or been pumped through the cementer 110 to a pressure shut-off against the baffle profile, hydraulic pressure may be applied in the casing string 14 to be cemented.

The hydraulic pressure may be increased to shear the opening sleeve assembly opening shear member 98 at an opening shear pressure to move the opening sleeve assembly 135 to the opened position. An annular gap 30 may be formed between the housing 12 and the outer diameter of the opening sleeve assembly 135. An annular gap may be provided beneath the lower seal 100 between component leader lines for component numbers 46 and 11 in FIG. 1, such that once both the upper and lower seals on the opening sleeve break seal contact, the opening sleeve assembly may move freely downward until such time that the upper seal 92 contacts the seal re-entry surface 32. Thereby, the opening sleeve assembly 135 may move unobstructed, with full travel to the opened position. A portion 330 of the gap may include a further increased ID to accommodate unrestricted movement of the non-drillable portion 37 of the opening sleeve assembly 135 into an opened position. The increased ID of annular gap 330 relative to the ID of gap 30 provides a latch area for the lock ring 82 on the closing sleeve 174, as well as promotes free movement of the opening sleeve 135 for a sufficient axial amount of travel to get the sleeve 135 out of the way of the cementing ports 34 and inflation ports 26.

Thereafter, actuating fluid may be pumped at a packer actuation pressure to actuate/inflate the packer element 66. The check-valve member 62 may retain the actuation fluid pressure within the packer assembly 70. To further retain actuation fluid pressure within the packer assembly, seals 58 and 158 may prevent pressure leak-off external to the packer 70. Fluid pressure within the central through bore 19 then may be increase to a secondary opening device opening pressure or cementing port opening pressure to open/rupture the secondary opening device/rupture disk 18. Thereafter, cementing fluid may be circulated through the casing 14, through the opened cementing ports 34 and into the wellbore annulus 13.

As the last portion of the cement is pumped, the closing plug 200 may be released from a cementing head on top of the casing string, and pumped to the closing sleeve assembly 174. The closing plug 200 may engage the closing plug seating surface 79. Fluid pressure may be increased to a closing sleeve assembly shear member shearing pressure to move the closing sleeve assembly 174 to the closed position. Thereby the cementing port(s) 34 and the inflation ports 26 may be sealingly isolating from and closed to fluid communication with the central through bore 19. As the closing sleeve assembly 174 is moved to the closed position, the lock ring 82 may engage undercut/lock portion 83 of the housing 12 to secure the closing sleeve assembly in the closed position. Thereafter, the cement may be allowed to cure or harden until a selected time at which the cement remaining within the casing 14 may be drilled out with a drill bit.

The strength of the shear members 76 and 98 may be thus controlled according to well known techniques to insure that shear member 98 is sheared within a selected pressure range. Thereafter the rupture disk 18 ruptures at a higher-pressure to open the cementing ports 34 in the tool. A change in hydraulic pressure will be encountered once the closing plug 200 or valve member seats on the closing seat 79 to shear the closing shear member 76 and move the closing sleeve to the closed position. As the closing pressure acts across the full cross-sectional area of the plug 200 and upper surfaces of the closing sleeve assembly, closing fluid pressures are generally lower than either the initial opening or secondary opening pressure. In the absence of a plug or valve member 200 seated on the closing sleeve, the closing sleeve is pressure balanced, typically having no seal area differential across the sleeve. Movement of the closing sleeve is dependent upon forces generated against the closing plug 200.

The drill bit may drill through any cement in the casing above the plug 200, drill out the plug, and drill out the drillable portions 78 of the closing sleeve assembly. Thereafter, the drill bit may continue drilling out cement within the non-drillable portions of the closing sleeve member, including tubular-shaped closing sleeve 74, and engage the drillable portions 35 of the opening sleeve assembly. Because the cementing ports are axially above the top of the opened opening sleeve assembly, it is likely that no additional cement will be drilled out from within the cementer housing 12.

Referring to FIG. 4, after drilling out the first portion 235 of the drillable portion 35 including the threads engaging the drillable portion 35 with the non-drillable portion 37, the lower portion 335 of the opening sleeve assembly may fall or be pushed by the drill bit and drill string into engagement with the opening sleeve portion seat 11 in the housing 12. Thereby, the lower portion 335 of the opening sleeve assembly 135 may wedge into engagement with the housing 12 to prevent rotation of the lower portion 335 under the drill-bit, such that the drill bit may efficiently drill out the lower portion 335.

A significant feature of the present invention is that subsequent drill-out of the stage cementer may facilitated a relatively large, full bore diameter through bore in the stage cementer 10, 110 and packer assembly 70, over the axial length of the tools 10, 110, 70. For example, a cementer for use on 2⅜ nominal OD pipe is thus exemplary of a slim-hole/small diameter stage cementer according to the present invention. A suitable 2⅜ tool as indicated in FIG. 1 may thus have a full bore, roughly two-inch through bore after drill-out.

Those skilled in the art will appreciate that other embodiments of packer-collar type stage cementers may include other types of hydraulic and/or mechanical packers. Various types of inflatable packer elements 66 also may be used, as known to those skilled in the art.

A cementing operation, as discussed herein is used broadly to mean any operation which inputs a generally cementitious fluid or a fluid used in connection with a cementing operation, such as a flush fluid, into the annulus around a casing to better secure and seal the casing in the wellbore 13. An actuation fluid may also be a fluid used in a cementing fluid, such as water or flush fluid. The terms "sealing surface," "check valve," "rupture disk," and "shear member" as used herein are broadly intended to cover those structures or devices which achieve these purposes. The seating surface thus may not form a fluid-tight hydraulic seal with the valve member or surface, which engages the seating surface. The check valve member 62 that retains actuation fluid in the packer element once inflated is broadly intended to cover any valve device for achieving this objective. A secondary opening device or rupture disk may be formed of any material and geometric configuration for rupturing or opening allowing fluid to pass by the secondary opening device or port containing the device when fluid pressure reaches a predetermined pressure range whereupon the device fails, opens or ruptures. A shear member is any member intended to fail or shear when a selected axial load or force is applied to the shear member, and includes shear pins and shear rings.

The terms "opening sleeve assembly" and "closing sleeve assembly" as used herein are broadly intended to mean devices which move in response to hydraulic pressure, or optionally by engagement with a plug, baffle, or other member to block fluid flow and thereby increase axial forces for movement. The opening sleeve assembly and the closing sleeve assembly as shown herein are generally tubular-shaped, which is a preferable construction. The opening sleeve assembly and closing sleeve assembly could be modified however, to have a structure that was more ring-shaped than tubular-shaped.

Those skilled in the art will appreciate that the stage cementer of the present invention may be used to facilitate one, two, or more stages of cementing in a well. The stage cementer provides the desired hydraulic and mechanical support for a cement stage in a wellbore above the closed stage cementer. Drillable members and cement remaining in the wellbore may be relatively easily drilled out after the cementitious material has cured or hardened in the well.

Various modifications to the multi-stage cementer and packer collar and to the method as disclosed herein should be apparent from the above description of preferred embodiments. Although the invention has thus been described in detail for these embodiments, it should be understood that this explanation is for illustration, and that the invention is not limited to these embodiments. Alternate components and operating techniques will be apparent to those skilled in the art in view of this disclosure, including the addition of float equipment. Additional modifications are thus contemplated and may be made without departing from the spirit of the invention, which is defined by the claims.

What is claimed is:

1. A stage cementer assembly for a cementing operation to cement at least a portion of a tubular casing string within a subterranean wellbore, the stage cementer including a cementer axis aligned along a central through bore, comprising:

a cementer housing for fixed interconnection with and positionable along the casing string, the cementer housing including one or more cementing ports for passing fluid from the central through bore to outside the cementer housing, the cementer housing including an upper end above a lower end;

an opening sleeve assembly positioned within the cementer housing, the opening sleeve assembly including a non-drillable opening sleeve portion and a drillable opening sleeve portion, the opening sleeve assembly having a seal differential with respect to the cementer housing for moving the opening sleeve assembly in response to a fluid pressure in the cementer housing from a closed position for preventing passing fluid through the one or more cementing ports to an opened position for passing fluid through the one or more cementing ports;

a closing sleeve assembly positioned within the cementer housing, the closing sleeve assembly including a non-drillable closing sleeve portion and a drillable closing sleeve portion, the closing sleeve assembly including a closing plug seating surface for sealingly engaging a closing plug thereon to move the closing sleeve assembly in response to another fluid pressure in the stage cementer housing from an opened position for passing fluid through he cementing port to a closed position for preventing fluid from passing through the cementing ports; and the cementer housing including an opening sleeve seat along the central through bore for preventing rotation the drillable sleeve portion during drill-out.

2. The stage cementer assembly as defined in claim 1, wherein:

the opening sleeve assembly further comprises an opening plug seating surface having a minimum opening seat nominal through bore diameter; and the closing sleeve assembly further comprises the closing plug seating surface having a minimum closing seat nominal through bore diameter greater than the minimum opening seat nominal through bore diameter.

3. The stage cementer assembly as defined in claim 1, further comprising:

one or more inflation ports through the cementer housing, the one or more inflation ports positioned along the central axis axially lower than the one or more cementing ports;

a tubular-shaped outer case circumferentially encompassing an external surface of the cementer housing, the tubular-shaped outer case having an upper end in sealed engagement with the cementer housing and positioned axially between the one or more cementing ports and the one or more inflation ports, the tubular-shaped outer case forming an actuation fluid flow path for conducting an actuation fluid between an external surface of the cementer housing and an inner surface of the outer case, and from the one or more inflation ports to a packer assembly;

the hydraulically actuatable packer assembly mechanically interconnected with the cementer housing, the packer assembly having a packer element actuatable in response to an actuation fluid pressure of the actuation fluid, subsequent to moving the opening sleeve assembly from the closed position to the opened position;

a check valve member for preventing the actuation fluid from deactuating an actuated packer element; and a secondary opening device secured to the cementer housing in at least one of the one or more cementing ports for opening at least one of the one or more cementing ports in response to a selected cementing port opening fluid pressure in the cementer housing when the packer element has been actuated to a set position.

4. The stage cementer assembly as defined in claim 3, further comprising:

a pressure equalizing valve in the cementer housing for equalizing a fluid pressure in an opening sleeve annulus with a wellbore fluid pressure in the wellbore annulus while running the stage cementer into the wellbore.

5. The stage cementer assembly as defined in claim 3, wherein the cementer housing comprises:

an upper body having lower threads thereon; and a lower body having upper threads thereon for mating engagement with the lower threads on the upper body, for securing the opening sleeve assembly within an interior portion of the cementer housing.

6. The stage cementer assembly as defined in claim 1, further comprising:

an opening shear member of a first selected shear strength for disengagingly securing the opening sleeve assembly to the cementer housing, and for shearing when the opening sleeve assembly moves from the closed position to the opened position.

7. The stage cementer assembly as defined in claim 6, further comprising:

a closing shear member of a second selected shear strength for disengagingly securing the closing sleeve assembly to the cementer housing and for shearing when the closing sleeve assembly moves from the opened position to the closed position.

8. The stage cementer assembly as defined in claim 1, wherein the opening sleeve seat of the cementer housing further comprises:

a substantially frustoconical wedge portion formed at an angle with respect to the cementer axis of up to 70 degrees.

9. The stage cementer assembly as defined in claim 8, wherein a lower portion of the drillable opening sleeve portion includes an engagement surface for engaging the substantially frustoconical wedge portion to prevent rotation of the drillable opening sleeve portion during drill-out.

10. The stage cementer assembly as defined in claim 1, wherein both the drillable opening sleeve portion and the drillable closing sleeve portion are formed from a composite material.

11. The stage cementer assembly as defined in claim 1, further comprising:

one or more first splined connections for securing at least a portion of the opening sleeve assembly to the cementer housing; and one or more second splined connections for securing the opening sleeve assembly to the closing sleeve assembly to prevent rotation of the drillable closing sleeve portion of the drillable closing sleeve and drillable portion of the opening sleeve assembly during drill-out.

12. The stage cementer assembly as defined in claim 1, wherein the drillable closing sleeve portion is rotatably secured to the opening sleeve assembly during drill-out of the drillable closing sleeve portion.

13. The stage cementer assembly as defined in claim 1, wherein the cementer housing has a maximum outer diameter of not more than five inches.

14. The stage cementer assembly as defined in claim 1, further comprising:

a locking member retained on the closing sleeve assembly; and a lock member positioned within the cementer housing for engagement with the locking member on the closing sleeve assembly to lock the closing sleeve assembly in the closed position.

15. The stage cementer assembly as defined in claim 14, wherein the lock member is positioned between an upper seal on the closing sleeve assembly and a lower seal on the closing sleeve assembly when the closing sleeve assembly is in the closed position.

16. A method of operating a stage cementer, comprising:

releasably securing an opening sleeve assembly within a central through bore in a cementer housing in a closed position to close a cementing port in the cementer housing;

releasably securing a closing sleeve assembly within the cementer housing in an opened position;

providing an opening sleeve seat within the central through bore of the cementer housing, the opening sleeve seat having a minimum through bore ID less than an outer diameter of a drillable opening sleeve portion of the opening sleeve assembly;

thereafter positioning the cementer housing along a tubular casing string and within a subterranean wellbore;

thereafter increasing a fluid pressure within the cementer housing acting on a seal differential of the opening sleeve assembly with respect to the cementer housing to move the opening sleeve assembly with respect to the cementer housing to move the opening sleeve assembly from the closed position to an opened position to open the cementing port in the cementer housing;

thereafter pumping cementing fluid through at least a portion of the central through bore, then through the cementing port to outside the cementer housing;

seating a closing plug on the closing sleeve assembly;

thereafter increasing fluid pressure in the casing string above the closing plug to another fluid pressure for moving the closing sleeve assembly from the opened position to a closed position;

thereafter drilling out a drillable closing sleeve portion of the closing sleeve assembly and a drillable opening sleeve portion of the opening sleeve assembly while the drillable opening sleeve portion is rotatably fixed to the opening sleeve seat to prevent rotation of the drillable opening sleeve portion during drill out.

17. A method as defined in claim 16, further comprising:

providing an inflation port in the cementer housing positioned axially lower than the cementing port;

blocking the cementing port with a secondary opening device;

sealingly encasing an external portion of the cementer housing with a tubular-shaped outer case positioned axially below the cementing port, the cementing port not penetrating the outer case;

providing a hydraulically actuatable packer assembly mechanically interconnected with the cementer housing, the packer assembly having an packing element actuatable in response to an actuation fluid pressure from an actuation fluid;

hydraulically interconnecting the packer assembly and the inflation port at least partially through a flow conduit between an outer surface of the cementer housing and an inner surface of the outer case;

subsequent to moving the opening sleeve assembly to the opened position, actuating the packer assembly to a set position by increasing the fluid pressure in the actuation fluid to the actuation pressure to set the packer assembly;

retaining the packer assembly in the set position with a one-way hydraulic check-valve; and thereafter further increasing fluid pressure in the cementer housing to open the secondary opening device positioned in the cementing port to pump cementing fluid through the opened cementing port.

18. The method as defined in claim 16, further comprising:

securing at least a portion of the opening sleeve assembly to the cementer housing; and securing the opening sleeve assembly to the closing sleeve assembly when the closing sleeve assembly is in the closed position, to prevent rotation of the drillable closing sleeve portion of the closing sleeve assembly and a first drillable portion of the opening sleeve assembly during drill-out.

19. The method as defined in claim 16, further comprising:

fabricating the drillable opening sleeve portion and the drillable closing sleeve portion from a composite material.

20. The method as defined in claim 16, further comprising:

retaining a locking member on the closing sleeve assembly; and positioning a lock member within the cementer housing for engagement with the locking member on the closing sleeve assembly to lock the closing sleeve assembly in the closed position.

21. The method as defined in claim 20, wherein the lock member is positioned between an upper seal on the closing sleeve assembly and a lower seal on the closing sleeve assembly when the closing sleeve assembly is in the closed position.

22. The method as defined in claim 16, further comprising:

forming the opening sleeve seat to include a substantially frustoconical wedge portion for engaging and preventing rotation of the drillable opening sleeve portion during drill-out.

* * * * *